US005243156A

United States Patent [19]

Shirasaka

[11] Patent Number: 5,243,156

[45] Date of Patent: Sep. 7, 1993

[54] VEHICLE POWER SEAT MULTIPLE SWITCH ASSEMBLY WITH SELECTIVE CONTROLLER MOVABLE IN VERTICAL AND HORIZONTAL DIRECTIONS

[75] Inventor: Takeshi Shirasaka, Furukawa, Japan

[73] Assignee: Alps Electric Co., Ltd., Tokyo, Japan

[21] Appl. No.: 814,546

[22] Filed: Dec. 30, 1991

[30] Foreign Application Priority Data

Jan. 18, 1991 [JP] Japan ..... 3-4632[U]

[51] Int. Cl.[5] ..... H01H 9/00; G05G 1/00

[52] U.S. Cl. ..... 200/5 R; 200/18; 200/50 C

[58] Field of Search ..... 200/5 R, 5 B, 50 C, 200/18

[56] References Cited

U.S. PATENT DOCUMENTS 5,021,614 6/1991 Sasaki et al. ..... 200/5 R
5,128,500 7/1992 Hirschfeld ..... 200/5 R
5,130,501 7/1992 Maeda ..... 200/50 C

FOREIGN PATENT DOCUMENTS 1-17057 5/1989 Japan .

*Primary Examiner*—J. R. Scott
*Attorney, Agent, or Firm*—Guy W. Shoup; Patrick T. Bever

[57] ABSTRACT

A vehicle power seat switch designed to prevent a knob from vibrating has a switch body incorporating plurality of switch elements and having projecting shafts movably disposed to drive the switch elements, and at least one knob having pairs of wall portions formed on the reverse side, each pair of wall portions facing each other with one of the projecting shafts interposed therebetween, the knob being moved to operate each of the switch elements to adjust the position of the vehicle seat. Elastic extensions are integrally provided on one of the pairs of wall portions so as to be able to contact the outer circumferential surface of the corresponding one of the projecting shafts. It is thereby possible to reduce the noise level at a comparatively small parts cost.

2 Claims, 7 Drawing Sheets

VEHICLE POWER SEAT MULTIPLE SWITCH ASSEMBLY WITH SELECTIVE CONTROLLER MOVABLE IN VERTICAL AND HORIZONTAL DIRECTIONS

BACKGROUND OF THE INVENTION

This invention relates to a vehicle power seat switch for adjusting the position of a vehicle seat in the longitudinal direction of a vehicle and in other directions.

A vehicle power seat switch for adjusting the positions of a bottom portion and a back portion of a vehicle seat, e.g., the one disclosed in Japanese Utility Model Publication HEI 1-17057, has been proposed. FIG. 10 is a front view of a vehicle power seat switch of this kind, FIG. 11 is a cross-sectional view of the power seat switch shown in FIG. 10, FIG. 12 is a side view of the power seat switch of FIG. 10, FIG. 13 is a side view of a vehicle seat provided with the power seat switch of FIG. 10, FIG. 14 is a diagram of a reverse side of a knob of the power seat switch of FIG. 10, FIG. 15 is a cross-sectional view taken along the line 15—15 of FIG. 14, and FIG. 16 is a cross-sectional view taken along the line 16—16 of FIG. 14.

In general, a vehicle seat has a seat bottom 31 and a seat back 32, as shown in FIG. 13. A conventional vehicle power switch provided for such a vehicle seat is composed of, as shown in FIG. 10, a switch body 33 attached in the vicinity of the seat bottom 31, a knob 34 for adjusting the seat bottom 31 in the longitudinal direction of the vehicle and in the vertical direction, and another knob 35 disposed above the knob 34 and operated to adjust the tilt position of the seat back 32.

On the switch body 33 are provided projecting shafts 36 to 40 arranged in a horizontal direction and engaged with the knob 34, and projecting shafts 41 and 42 arranged in the vertical direction and engaged with the knob 35, as shown in FIG. 11. Of the projecting shafts 36 to 40, the shafts 36 and 40 located at opposite end positions have circular cross sections and disposed vertically movably, the projecting shaft 38 at the center has a circular cross section and disposed horizontally movably. The other projecting shafts 37 and 39 have generally square cross sections and are fixed to the switch body 33. The upper projecting shafts 41 and 42 respectively have circular cross sections, and the projecting shaft 41 is disposed horizontally movably while the projecting shaft 42 is fixed to the switch body 33.

The lower knob 34 is formed of an elastic synthetic resin, and has upper and lower wall portions 51 and 52 which face each other with the projecting shaft 36 interposed therebetween, guide projections 53*a* to 53*d* disposed outside the four corners of the projecting shaft 37, side wall portions 54 and 55 which face each other with the projecting shaft 38 interposed therebetween, guide projections 56*a* to 56*d* disposed outside the four corners of the projecting shaft 39, and upper and lower wall portions 57 and 58 which face each other with the projecting shaft 40 interposed therebetween. The upper knob 35 is also formed of an elastic synthetic resin, and has side wall portions 59 and 60 which face each other with the projecting shaft 41 interposed therebetween, and wall portions 61 and 62 positioned around the projecting shaft 42. As shown in FIG. 12, a pair of circular-arc projections 40*a* and 40*b* are formed on upper and lower portions of the outside surface of the projecting shaft 40 along the circumferential direction thereof. Similar projections are also provided on the projecting shaft 36. A circular-arc projection 41*a* is also formed on a side portion of the outside surface of the projecting shaft 41 along the circumferential direction thereof, and another projection (not shown) is formed in the same manner on an opposite portions of the surface of this shaft. Similar projections are also formed on the projecting shafts 38 and 41.

As shown in FIG. 15, a groove 54*a* for engagement with the corresponding one of the projections of the projecting shaft 38 is formed in the wall portion 54, and a groove 55*a* is also formed in the wall portion 55 facing the wall portion 54. Similar grooves are also formed in the wall portions 59, 60, 61, and 62. As shown in FIG. 16, grooves 57*a* and 58*a* for engagement with the projections 40*a* and 40*b* of the projecting shaft 40 are formed in the wall portions 57 and 58, and similar grooves are also formed in the wall portions 51 and 52.

A predetermined gap is provided between the projection 40*a* and the groove 57*a* and between the projection 40*b* and the groove 58*a*, so that the projecting shaft 40 is movable relative to the knob 34 to the left or right as viewed in FIG. 10. Similarly, a predetermined gap is provided between one of the projections of the projecting shaft 38 and the groove 54*a* and between the other projection of the projecting shaft 38 and the groove 55*a*, so that the projecting shaft 38 is movable relative to the knob 34 in the vertical direction. Also, a predetermined gap is provided between one of the projections of the projecting shaft 36 and the groove 51*a* and between the other projection of the projecting shaft 36 and the groove 52*a*, so that the projecting shaft 36 is movable relative to the knob 34 to the left or right as viewed in FIG. 10. If each of these gaps is smaller than the predetermined size, the slide resistance of the projecting shafts 36, 38, and 40 is so large that there is a risk of occurrence of return failure after the knob 34 has been moved. The risk of knob 34 return failure is particularly high if the gap is further reduced with a change in the atmospheric temperature.

When the knob 34 of this vehicle power seat switch is attached to the switch body 33, the knob 34 is disposed so that its reverse side faces the switch body, and so that the wall portions 51 and 52 engage with the projecting shaft 36, the wall portions 54 and 55 with the projecting shaft, and the wall portions 57 58 with the projecting shaft 40. In this state, the knob 34 is pressed toward the switch body. By this pressing, the wall portions 57 and 58 are displaced outward by the projections 40*a* and 40*b*, and the projections 40*a* and 40*b* are then fitted in the grooves 57*a* and 58*a*. At this time, the wall portions 57 and 58 are restored to the original state. Simultaneously, the wall portions 51, 52, 54, and 55 are displaced and restored in the same manner. The knob 34 is thereby prevented from coming off the projecting shafts 36, 38, and 40, that is, it is maintained in the state of being attached to the switch body 33.

In this state, if the knob 34 is moved, for example, to the left as viewed in FIG. 11 by being held by operator fingers, the projecting shaft 38 is pressed leftward as viewed in FIG. 11 by the side wall portion 55 and a switch element incorporated in the switch body 33 is driven through the projecting shaft 38. An unillustrated electrical driving means is thereby operated so that the seat bottom 31 is moved to the left as viewed in FIG. 11, that is, in the direction of the vehicle front. At this time, the projecting shafts 36 and 40 are not moved in the horizontal direction, so that the projection 36 moves relative to the knob 34 between the wall portions 51 and 52, and the projection 40 also moves relatively between the wall portions 57 and 58. When the knob 34 is thereafter released from the operator's hand, the projecting shaft 38 is forced back to the right as viewed in FIG. 11 by a restoring force so as to press the side wall portion 55, and the knob 34 is thereby returned to the neutral position, so that the movement of the seat bottom 31 is stopped. Similarly, if the knob 34 is moved to the right as viewed in FIG. 11, the seat bottom 31 is moved rearward.

If a fore portion of the knob 34 is moved upward, the knob 34 is rotated on the projecting shaft 40 and the projecting shaft 36 is pressed upward by the lower wall portion 52, so that another switch element incorporated in the switch body 33 is thereby driven through the projecting shaft 36. An unillustrated electrical driving means is thereby operated to lift a fore portion of the seat bottom 31. At this time, the projecting shaft 38 is not moved in the vertical direction, but moves relative to the knob 34 between the wall portions 54 and 55. When the knob 34 is thereafter released from the fingers, the projecting shaft 36 is forced back downward by a restoring force so as to press the lower wall portion 52, and the knob 34 is thereby returned to the neutral position, so that the movement of the seat bottom 31 is stopped. During this operation, the projecting shaft 38 does not move forward or rearward; it moves relatively between the wall portions 54 and 55. Similarly, if the fore portion of the knob 34 is moved downward, the fore portion of the seat bottom 31 is moved downward. If a rear portion of the knob 34 is moved in a vertical direction, a rear portion of the seat bottom 31 is moved upward or downward. Further, if the knob 34 as a whole is moved in a vertical direction, the whole seat bottom 31 is moved upward or downward. If an upper portion of the other knob 35 is moved in a longitudinal direction of the vehicle, the knob 35 is rotated on the projecting shaft 42, the projecting shaft 41 is pressed against the side wall portion 59 or 60; and an unillustrated switch element incorporated in the switch body 33 is driven through the projecting shaft 41. An unillustrated electrical driving means is thereby operated to change the inclination of the seat back 32.

In the above-described vehicle power seat switch, the predetermined gaps are provided between the knob 34 and the engagement portions of the switch body 33, i.e., between the projection 40*a* of the projecting shaft 41 and the groove 57*a*, between the projection 40*b* and the groove 58*a*, between one of the projections of the projecting shaft 38 and the groove 54*a*, between the other projection of the projecting shaft 38 and the groove 55*a*, between one of the projections of the projecting shaft 36 and the groove 51*a* and between the other projection of the projecting shaft 36 and the groove 52*a*, and the knob 34 is, therefore, not restrained in the neutral position. There is therefore the problem of the knob 34 vibrating to generate noise. A means for solving this problem has been provided which comprises an resilience force application means which is provided between the projecting shafts and the knob to apply a resilience force to the knob to prevent vibrations thereof. However, special parts such as springs are required for the provision of this resilience force application means, resulting in an increase in the total number of parts and, hence, an increase in cost.

SUMMARY OF THE INVENTION

In view of these problems, an object of the present invention is to provide a vehicle power seat switch designed to prevent occurrence of knob vibrations without specially adding springs and other members.

To achieve this object, according to the present invention, there is provided a vehicle power seat switch for adjusting the position of a vehicle seat comprising a switch body incorporating plurality of switch elements and having projecting shafts for driving the switch elements, the projecting shafts being movably disposed on the switch body; and at least one knob having pairs of wall portions formed on the reverse side, each pair of wall portions facing each other with one of the projecting shafts interposed therebetween, the knob being moved to operate each of the switch elements to adjust the position of the vehicle seat; wherein an elastic extension is integrally provided on at least one of the two wall portions constituting at least one of the pairs of wall portions so as to be able to contact an outer circumferential surface of the corresponding one of the projecting shafts.

In the power seat switch thus constructed, in case where an elastic extension is provided on only one of a pair of wall portions facing each other, this elastic extension contacts an outer circumferential surface of the corresponding one of the projecting shaft so that the projecting shaft is pressed against the other of this pair of the wall portions by the resiliency force of the elastic extension, that is, the other wall portion also contacts the outer circumferential surface of the projecting shaft. The projecting shaft is therefore resiliently pinched between the elastic extension and the other wall portion. If in this state the knob is moved in a direction parallel to this pair of wall portions by being held by operator's fingers, the projecting shaft moves relative to the knob between the wall portions. At this position, since the wall portions are elastically pinching the projecting shaft as mentioned above, the slide resistance between the knob and the projecting shaft is comparatively small. Therefore there is substantially no possibility of failure to return the knob after the knob movement. If the knob is moved in the direction of one of the pair of wall portions, the elastic extension drives the corresponding switch element through the projecting shaft while being elastically deformed. During this operation, as mentioned above, the projecting shaft is elastically pinched between the elastic extension and the other wall portion. It is thereby possible to prevent the knob from vibrating without requiring special additional parts such as springs. The same effect can also be ensured in a case where elastic extensions are provided on both the pair of wall portions facing each other.

DESCRIPTION OF THE PREFERRED EMBODIMENT

A preferred embodiment of the present invention will be described below with reference to FIGS. 1 to 9 of the accompanying drawings.

Figure 7:
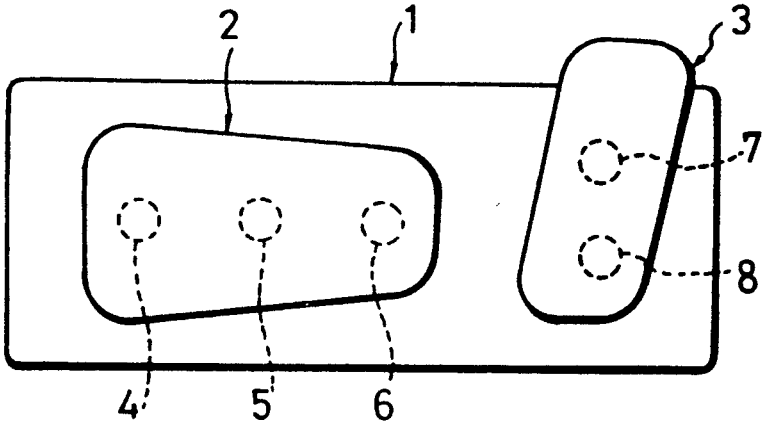
FIG. 7 is a front view of a power seat switch on which the knob shown in FIG. 1 is provided.
Figure 8:
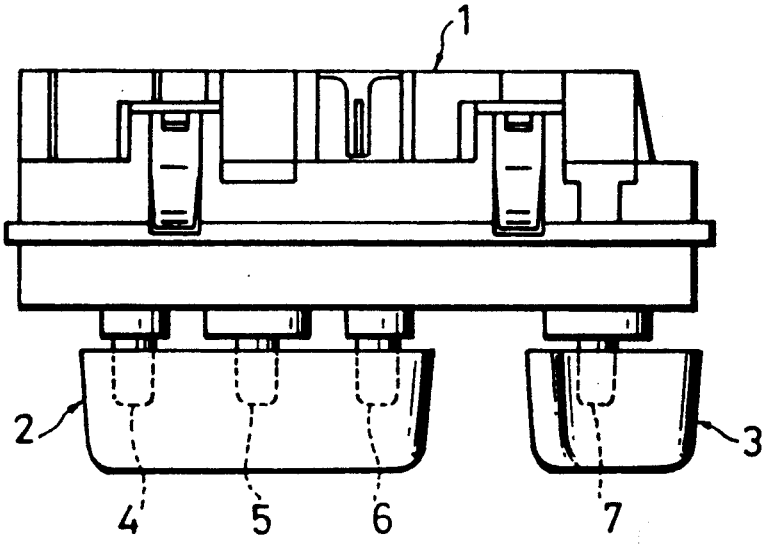
FIG. 8 is a plan view of the power seat switch shown in FIG. 7.

Referring first to FIG. 7, a vehicle power seat switch in accordance with the present invention has a body 1 attached in the vicinity of a vehicle seat such as that described above with reference to FIG. 13, a seat bottom operation knob 2 attached to the body 1, and a seat back operation knob 3 also attached to the body 1. The body 1 has five projecting shafts 4 to 8 and incorporates unillustrated switch elements driven through four of these projecting shafts, i.e., projecting shafts 4 to 7. The first projecting shaft 4 and the third projecting shaft 6 are vertically slidable, while the second projecting shaft 5 and the fourth projecting shaft 7 are horizontally slidable. The projecting shafts 4 to 6 are arranged in a horizontal direction, and the seat bottom operation knob 2 is attached to the body 1 by being engaged with the projecting shafts 4 to 6. The projecting shafts 7 and 8 are arranged in the vertical direction, and the seat back operation 3 is attached to the body 1 by being engaged with the projecting shafts 7 and 8.

Figure 9:
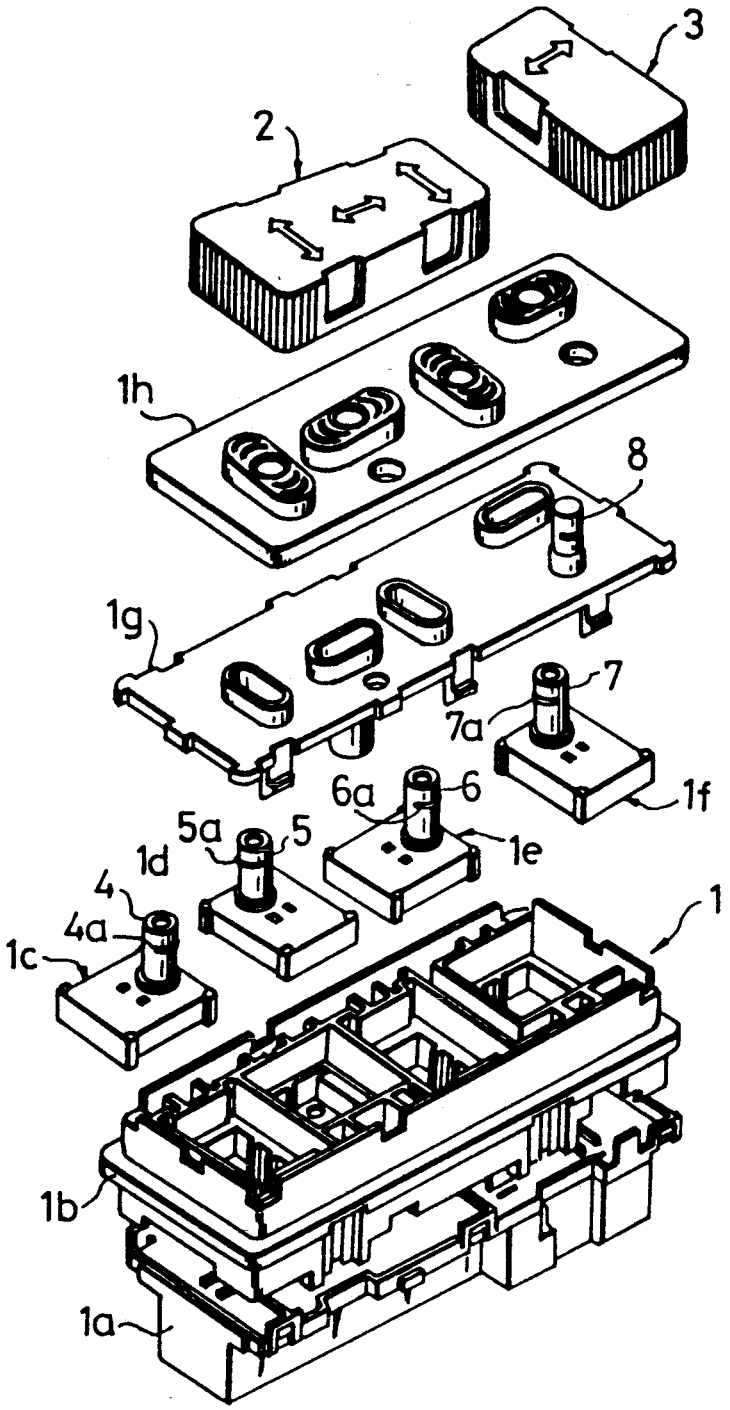
FIG. 9 is an exploded perspective view of the power seat switch shown in FIG. 7.
Figure 10:
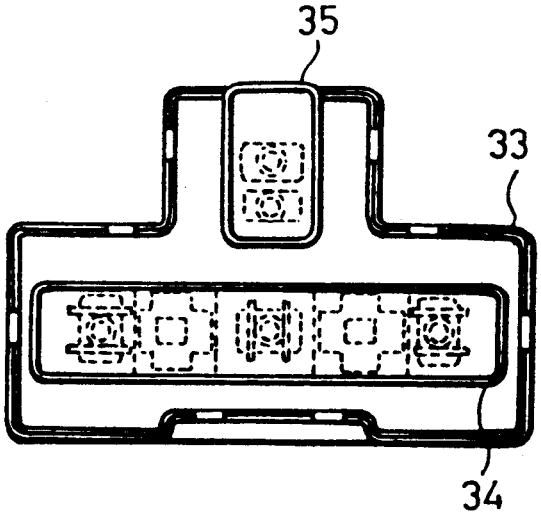
Fig.10 PRIOR ART
FIG. 10 is a front view of a conventional vehicle power seat switch.
Figure 11:
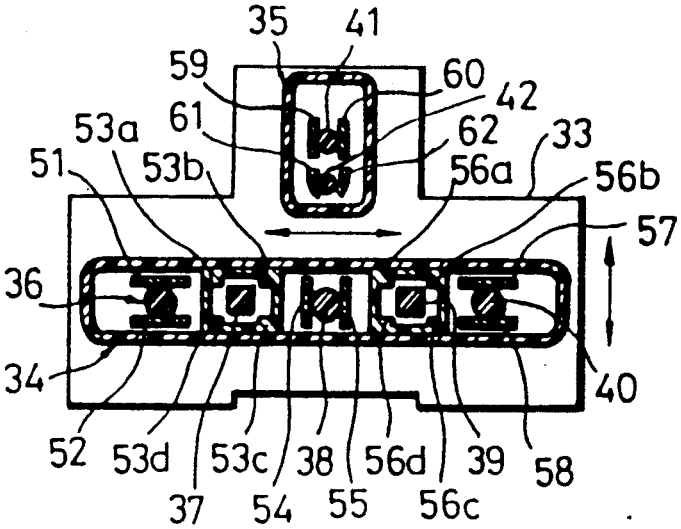
Fig.11 PRIOR ART
FIG. 11 is a cross-sectional view of the power seat switch shown in FIG. 10.
Figure 12:
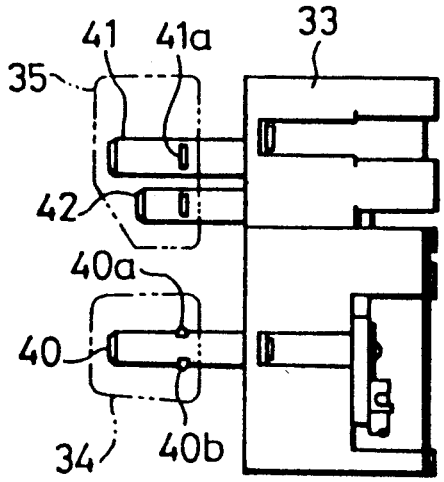
Fig. 12 PRIOR ART
FIG. 12 is a side view of the power seat switch of FIG. 10.

For example, the body 1 is disposed so that its sides located on the right-hand and left-hand sides of FIG. 7 face frontward and rearward, respectively, and its upper and lower sides face upward and downward, respectively. As shown in FIG. 9, the body 1 is composed of a terminal cover 1*a* having terminals (not shown), a case 1*b* attached on the terminal cover 1*a* and having unillustrated contacts, sliders 1*c* to 1*f* slidably disposed in the case 1*b*, a slider cover 1*g* which is attached on the case 1*b*, in which the projecting shafts 4 to 7 are inserted and on which the projecting shaft 8 is fixed, and an obverse cover 1*h* with which the obverse side of the slider cover 1*g* is covered. A pair of circular-arc projections 4*a* are formed on upper and lower portions of the outside surface of the first projecting shaft 4 along the circumferential direction thereof. A pair of circular-arc projections 6*a* are also formed on the third projecting shaft 6 in the same manner. A pair of circular-arc projections 5*a* are formed on left and right portions of the outside surface of the second projecting shaft 5 along the circumferential direction thereof, and a pair of circular-arc projections 7*a* are also formed on the fourth projecting shaft 7 in the same manner.

Figure 1:
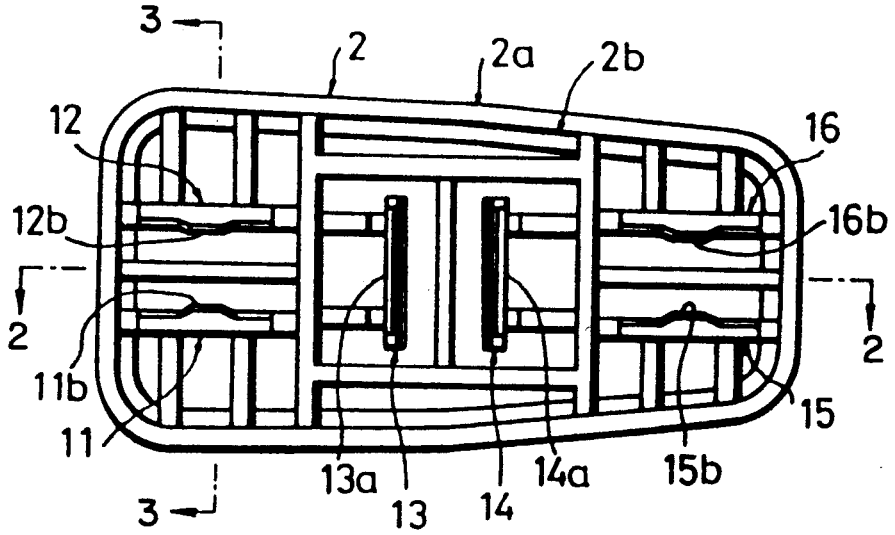
FIG. 1 is a bottom view of a vehicle power seat switch in accordance with an embodiment of the present invention.
Figure 2:
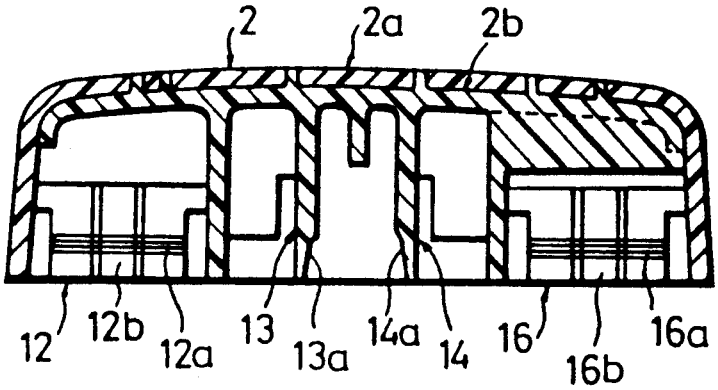
FIG. 2 is a cross-sectional view taken along the line 2—2 of FIG. 1.
Figure 3:
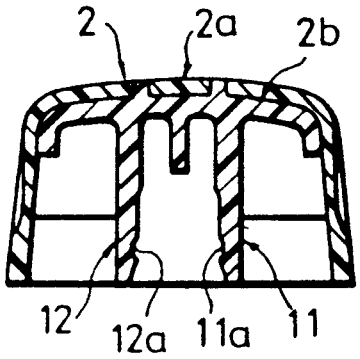
FIG. 3 is a cross-sectional view taken along the line 3—3 of FIG. 1.
Figure 4:
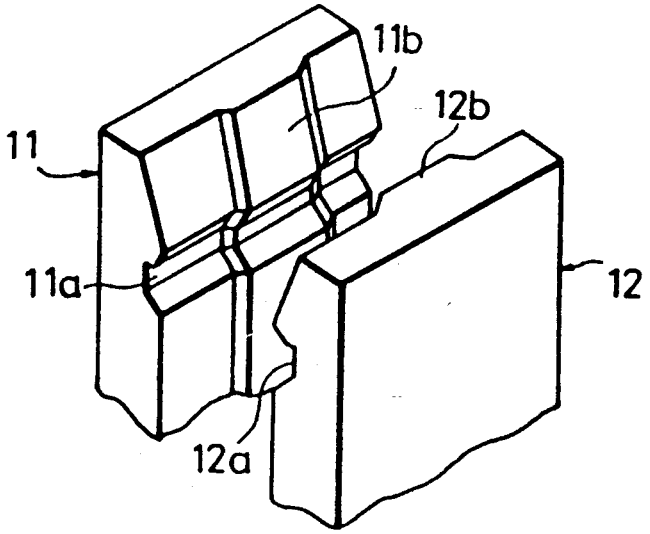
FIG. 4 is a perspective view of wall portions of the knob formed on the reverse side.
Figure 5:
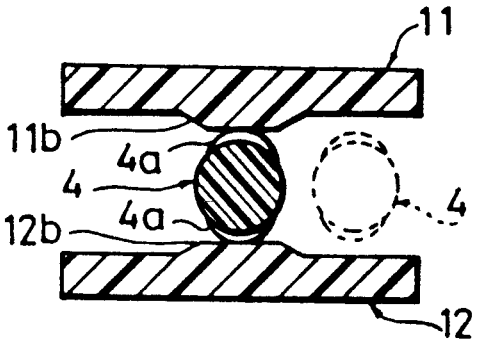
FIG. 5 is a cross-sectional view of a state in which a projecting shaft is engaged with the wall portions shown in FIG. 4.
Figure 6:
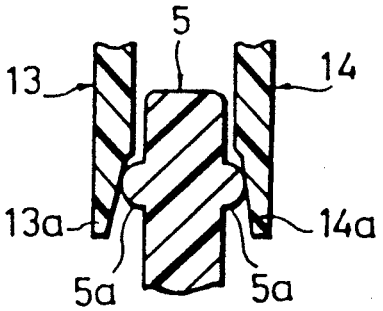
FIG. 6 is a cross-sectional view of elastic extensions of other wall portions of the knob formed on the reverse side.

As shown in FIG. 2, the seat bottom operation knob 2 is composed of an outer casing member 2*a* formed of a synthetic resin, and a partition wall member 2*b* provided on the reverse side of the outer casing member 2*a* and formed of an elastic synthetic resin. The partition wall member 2*b* has upper and lower wall portions 11 and 12 which face each other with the first projecting shaft 4 interposed therebetween, side wall portions 13 and 14 which face each other with the second projecting shaft 5 interposed therebetween, and upper and lower wall portions 15 and 16 which face each other with the third projecting shaft 6 interposed therebetween. As shown in FIG. 3, a groove 11*a* is formed in the upper wall portion 11 in parallel with the direction of sliding of the first projecting shaft 4 so as to be engagable with the corresponding projection 4*a*. Similarly, a groove 12*a* is formed in the lower wall portion 12. As shown in FIG. 4, protruding portions 11*b* and 12*b* are formed on the wall portions 11 and 12 at the center in the widthwise direction thereof so as to protrude closer to each other. The projections 4*a* of the first projecting shaft 4 are fitted to the protruding portions 11*b* and 12*b* when in a neutral position, i.e., the position indicated by the solid line in FIG. 5. Similarly, protruding portions 15*b* and 16*b* are formed on the upper and lower wall portions 15 and 16 at the center in the widthwise direction thereof. As shown in FIG. 6, an elastic extension 13*a* capable of contacting one of the projections 5*a* of the projecting shaft 5 is integrally formed on the side wall portion 13 at the extreme end thereof. Similarly, an elastic extension 14*a* capable of contacting the other projection 5*a* of the projecting shaft 5 is integrally formed on the side wall portion 14 facing the side wall portion 13 at the extreme end thereof. That is, the elastic extensions 13*a* and 14*a* contact opposite portions of the outside surface of the projecting shaft 6 in such a manner as to pinch this shaft.

When the knob 2 of this embodiment is attached to the body 1, the knob 2 is disposed so that its reverse side faces the body 1, and so that the the wall portions 11 and 12 engage with the projecting shaft 4, the wall portions 13 and 14 engage with the projecting shaft 5, and the wall portions 15 and 16 engage with the projecting shaft 6. As the knob 2 is pressed toward the body 1 in this state, the wall portions 11 and 12 are forcibly displaced outward by the projections 4*a* of the projecting shaft 4, and the projections 4*a* are thereafter fitted in the grooves 11*a* and 12*a*, so that the wall portions 11 and 12 are restored to the original state by their respective resiliency forces. Simultaneously, the wall portions 13 to 16 are displaced and restored in the same manner. The knob 2 is thereby prevented from coming off the projecting shafts 4 to 6. That is, the knob 2 is maintained in the state of being attached to the body 1. If in this state a fore portion of the knob 2, i.e., a portion on the left-hand side of FIG. 7 is moved upward by being held by operator's fingers, the knob 2 is rotated on the third projecting shaft 6 clockwise as viewed in FIG. 7, the first projecting shaft 4 is pressed by the lower wall portion 12 so that the slider 1*c* is driven upward to operate the corresponding switch element. An unillustrated electrical driving means is thereby operated to lift the fore, portion of the seat bottom 31 shown in FIG. 13. During this operation, as the knob 2 is rotated, the second projecting shaft 5 is slightly moved in the longitudinal direction of the knob 2 while generating a circular arc to be moved relative to the knob 2 with its projections 5*a* in light contact with the elastic extensions 13*a* and 14*a*. When the knob 2 is thereafter released from the operator's hand, the first projecting shaft 4 slides to the neutral position by the restoring force of the slider 1*c* to press the lower wall portion 12, so that the knob 2 is returned to the original state shown in FIG. 7 and the movement of the seat bottom 31 is stopped. During this operation, the second projecting shaft 5 moves relative to the knob 2 with its projections 5*a* in light contact with the elastic extensions 13*a* and 14*a*. Since the elastic extensions 13*a* and 14*a* have a certain elasticity, the slide resistance of the projecting shaft 5 is comparatively small, that is, there is substantially no possibility of knob 2 failing to return. When a rear portion of the knob 2 is vertically moved, the rear portion of the seat bottom 31 is correspondingly moved vertically. When the knob 2 as a whole is vertically moved, both the first and third projecting shafts 4 and 6 slide and the whole seat bottom 31 is correspondingly moved vertically.

Figure 13:
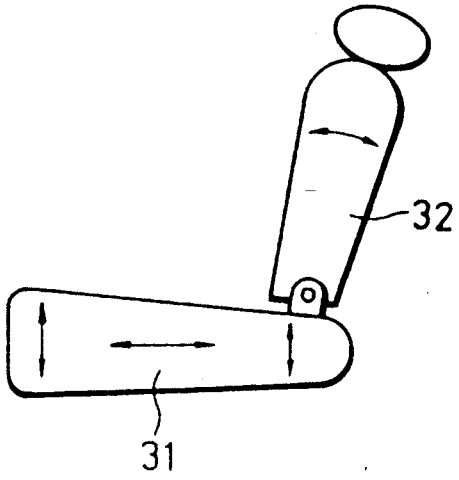
Fig. 13 PRIOR ART
FIG. 13 is a side view of a vehicle seat provided with the power seat switch of FIG. 10.
Figure 14:
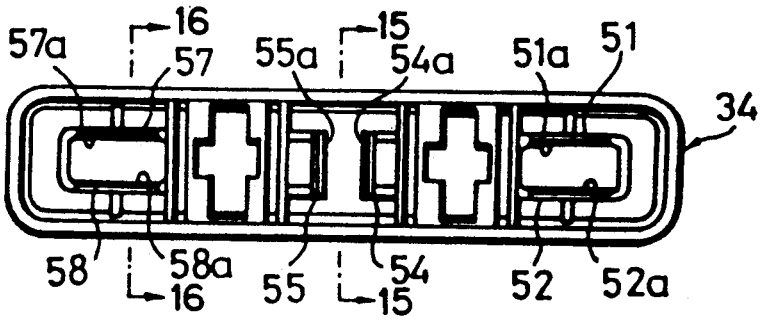
Fig.14 PRIOR ART
FIG. 14 is a diagram of a reverse side of a knob of the power seat switch of FIG. 10.
Figure 15:
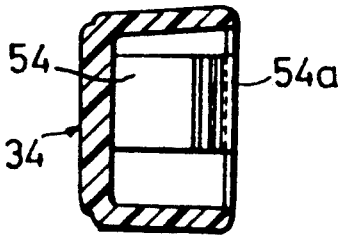
Fig.15 PRIOR ART
FIG. 15 is a cross-sectional view taken along the line 15—15 of FIG. 14.
Figure 16:
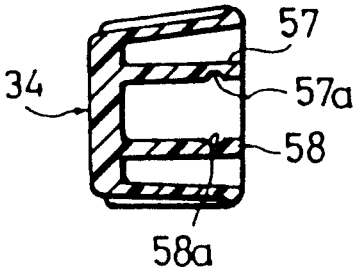
Fig.16 PRIOR ART
FIG. 16 is a cross-sectional view taken along the line 16—16 of FIG. 14.

When the knob 2 is moved to the left as viewed in FIG. 7, i.e., in a direction such that the wall portion 14 is moved in the direction of the second projecting shaft 5, the elastic extension 14*a* presses the second projecting shaft 5 to drive the corresponding switch element through the slider 1*d* while being elastically deformed, thereby forwardly moving the seat bottom 31 shown in FIG. 13. During this operation, the first projecting shaft 4 is moved relative to the knob 2 from the position indicated by the solid line in FIG. 5 to the position indicated by the broken line while its projections 4*a* are respectively engaging with the grooves 11*a* and 12*a*, so that gaps are formed between the projections 4*a* and the wall portions 11 and 12. The third projecting shaft 6 moves relatively between the wall portions 15 and 16 in the same manner. When the knob 2 is thereafter released from the operator's hand, the second projecting shaft 5 slides forward by the restoring force of the slider 1*d* to press the elastic extension 14*a*, and the knob 2 is returned to the original state shown in FIG. 7, so that the movement of the seat bottom 31 shown in FIG. 13 is stopped. When the knob 2 starts returning, no slide resistance occurs between the first projecting shaft 4 and the wall portions 11 and 12 since there is a gap located between one of the projections 4*a* of the first projecting shaft 4 and the wall portion 11 and another gap located between the other of the projections 4*a* and the wall portion 12, as indicated by the broken line in FIG. 5. Similarly, no resistance occurs between the third projecting shaft 6 and the wall portions 15 and 16. The switch is operated in the same manner when the knob 2 is moved to the right as viewed in FIG. 7. When the seat back operation knob 3 is moved forward or rearward, the inclination of the seat back 32 shown in FIG. 13 is changed.

In the thus-constructed embodiment, the second projecting shaft 5 contacts the elastic extensions 13*a* and 14*a* to prevent the knob 2 from vibrating, and there is no need for providing additional parts such as springs for preventing vibrations of the knob 2. Further, when the knob 2 is in the neutral position, the projections 4*a* of the first projecting shaft 4 are fitted to the protruding portions 11*b* and 12*b* so that the first projecting shaft 4 is pinched between the wall portions 11 and 12, and the third projecting shaft 6 is also pinched between the wall portions 15 and 16 in the same manner, thereby enabling the knob 2 to be stably maintained in the neutral position and to be prevented from freely moving.

By the effect of the above-described construction of the present invention, vibrations of the knob can be prevented without any additional parts such as springs, and the level of noise from the vehicle power seat switch can be reduced by the inexpensive means.

What is claimed is:

1. A vehicle power seat switch for adjusting the position of a vehicle seat comprising:

a switch body incorporating a plurality of switch elements and having a corresponding plurality of projecting shafts for driving said switch elements, said projecting shafts being movably disposed on said switch body; and a knob connected to a first of said plurality of projecting shafts, said knob having first and second wall portions disposed on opposite sides of a second of said projecting shafts;

wherein a resilient extension is integrally provided on one of said first and second wall portions such that an outer circumferential surface of said second of said projecting shafts is pinched between the resilient extension and the other of the first and second wall portions, and said resilient extension is resiliently deformed when the knob is moved in a first direction to operate said corresponding shaft.

2. The vehicle power seat switch of claim 1 further comprising third and fourth wall portions disposed on opposite sides of said first of said plurality of said projecting shafts, the third and fourth wall portions having protruding portions extending toward said first of said plurality of projecting shafts;

wherein when said power switch is in a neutral position, said protruding portions slidably connect said knob to said first of said plurality of projecting shafts, and when said power switch is moved in the first direction, said first of said plurality of projecting shafts becomes disengaged from said protruding portions.

* * * * *